United States Patent [19]

Haynes

[11] Patent Number: 4,781,006

[45] Date of Patent: Nov. 1, 1988

[54] BOLTED CHORD BAR CONNECTOR FOR CONCRETE CONSTRUCTION

[76] Inventor: Harvey H. Haynes, 3803 Randolph Ave., Oakland, Calif. 94602

[21] Appl. No.: 937,763

[22] Filed: Dec. 4, 1986

Related U.S. Application Data

[63] Continuation of Ser. No. 929,692, Nov. 10, 1986, abandoned.

[51] Int. Cl.[4] ..... E04C 5/18

[52] U.S. Cl. ..... 52/583; 52/587; 52/601

[58] Field of Search ..... 52/562, 565, 576, 601, 52/699, 703, 225, 583, 587, 167

[56] References Cited

U.S. PATENT DOCUMENTS

| | | | |
|---|---|---|---|
| 1,031,926 | 7/1912 | Hamsbrough | 52/601 |
| 1,098,792 | 6/1914 | Ficklen | 52/601 |
| 1,983,020 | 12/1934 | DeVol | 52/601 |
| 2,053,135 | 9/1936 | Dalton | 52/601 |
| 2,273,775 | 2/1942 | Strong | 52/601 |
| 2,986,848 | 6/1961 | Greene | 52/601 |
| 3,545,214 | 12/1970 | Grazel | 52/601 |
| 3,599,379 | 8/1971 | Tuska | 52/699 |
| 3,785,097 | 1/1974 | Seymour | 52/507 |
| 4,030,262 | 6/1977 | Dean | 52/583 |
| 4,182,092 | 1/1980 | Weaver | 52/699 |

*Primary Examiner*—David A. Scherbel
*Assistant Examiner*—Caroline D. Dennison
*Attorney, Agent, or Firm*—David O'Reilly

[57] ABSTRACT

A connector arrangement for joining adjacent chord bar reinforcements in wall panels for prefabricated tilt-up concrete buildings. The chord bar connection is comprised of a plurality of chord bars welded to a steel plate cast into the concrete of a prefabricated wall. Adjacent walls are connected by bolts passing through the metal plates attached to the cast in concrete chord bars. The bolting arrangement allows free movement of adjacent panels during dimensional changes caused by temperature and moisture variations in the concrete.

4 Claims, 3 Drawing Sheets

BOLTED CHORD BAR CONNECTOR FOR CONCRETE CONSTRUCTION

This application is a continuation of application Ser. No. 929,692 filed Nov. 10, 1986 now abandoned.

FIELD OF THE INVENTION

This invention relates to the assembling of prefabricated building walls, and more particularly relates to a chord bar connector for joining adjacent tilt-up prefabricated walls.

BACKGROUND OF THE INVENTION

In seismically active locations, tilt-up concrete buildings require extra steel reinforcement in the prefabricated wall panels. Typically reinforcing bars called, chord bars, are cast into the concrete walls and run the continuous length of the wall. The chord bars ensure that the walls remain standing during laterally imposed seismic forces. Because if walls collapse the roof will also collapse endangering lives.

Conventionally the method of joining chord bars in adjacent tilt-up wall panels is to use field welding techniques. In this method the adjacent walls are erected with a small gap between adjacent panels. Chord bars cast into each wall panel have their ends exposed in a notch at the respective edges of adjacent panels. The chord bar from one panel is connected to a chord bar in an adjoining panel by a short length of steel angle that is placed behind the adjacent chord bars and welded in place.

In the structural design of the connection the size and length of the weld is calculated to develop the full strength of the reinforcing chord bars. A significant disadvantage of this field-welded connection is the lack of reliability and quality, and therefore strength of the weld. Typical steel reinforcing bars for concrete conform to standard testing and material designations and are generally not weldable grades of steel. Weldable reinforcing bars are available, but this is expensive and requires special ordering.

Also, in order to produce the quality field-weld on typical reinforcing bars, the bars need to be preheated prior to welding and cooled after welding in accordance with established requirements. The preheating and cooling procedures are very difficult to accomplish successfully in the field. If the proper procedures are not carefully followed, the weld produced will be brittle and weak. Thus there is much concern in the prefabricated building industry about the quality of welds, and how the connections will perform under stress such as seismic activity applying lateral loads to the tilt-up concrete structures. If the welds break prematurely the walls can collapse.

Administrative officials in charge of building safety recognize the importance of the field welds and require an inspector on-site during the welding process. The inspector, however, does not necessarily witness each weld as they are very often high above the ground. Hence reliability in the quality of field-welding chord bar connections is still lacking.

Another disadvantage of this type of prefabricated wall connection is that it rigidly locks one panel to another which can result in cracks in the concrete panels from environmental causes of temperature and moisture changes. Cracks weaken the wall, are asthetically unattractive and permit water to leak into buildings.

Moisture changes in concrete result in volume changes of the material. Drying of concrete from water evaporation causes a decrease in volume of the concrete. This behavior is called drying shrinkage. The prefabricated tilt-up wall panels are usually erected when the concrete is only about ten days old. Drying shrinkage can be substantial during the first month or two of the concrete from exposure to sun and wind. Restraining adjacently connected panels from moving while drying shrinkage is occuring causes tensile stresses which can produce cracks. If the panels are permitted to freely move the development of cracks can be prevented. The present method of field-welding chord bar connections prevents panel movement; hence cracks can occur.

Seasonal variations in temperature can cause expansion and contraction movements in concrete panels that exceed the dry shrinkage movement. Thus, the expansion and contraction due to seasonal changes can also cause cracks in rigidly restrained panels.

It is one object of the present invention to provide a chord bar connecting system for joining adjacent prefabricated wall panels which provides superior structure reliability.

Yet another object of the present invention is to provide a chord bar connecting system for adjoining adjacent prefabricated concrete walls, which allows free movement of joined wall panels to minimize or prevent cracks.

Still another object of the present invention is to provide a chord bar connecting system in which adjacent prefabricated wall panels can be immediately secured after erection.

Yet another object of the present invention is to provide a chord bar connection system which compensates for misalignment between adjacent erected panels. Misalignment compensation is provided for by utilizing oversized holes in adjacent connecting face plates of the chord bar connectors.

Yet another object of the present invention is to provide a chord bar connector system which may be shop-welded to provide quality welds not available with field-welded techniques.

Yet another object of the present invention is to provide a chord bar connector system in which crushable spacers can be utilized to compensate for wall movement after erection.

Yet another object of the present invention is to provide a chord bar connector system utilizing face plates welded to chord bars and then adjacent face plates joined with bolts. Shims looseley fill the gap space between adjacent face plates.

Yet another object of the present invention is to provide chord bar connector for joining adjacent prefabricated concrete panels which substantially reduces concrete cracks due to expansion, contraction warping, or curling of walls.

Yet another object of the present invention is to provide a bolted chord bar connecting system which improves safety during construction should forces due to seismic activity occur. Adjacent prefabricated walls can be connected immediately after erection to provide improved safety against collapse.

Yet another object of the present invention is to provide a chord bar connecting system for joining adjacent wall panels which reduces construction schedule time.

The above and other objects, advantages and novel features of the invention will be more fully understood from the following detailed description and the accompanying drawing in which:

BRIEF DESCRIPTION OF THE INVENTION

The purpose of the present invention is to provide a chord bar connector and method that reliably develops full strength during stresses on walls of tilt-up buildings caused by seismic loading or other factors, and at the same time allows free movement of adjacent wall panels during temperature and moisture variations to minimize the development of cracks in the concrete.

The bolted chord bar connector and method of the present invention is comprised of two identical connectors that are imbedded or cast into adjacent prefabricated tilt-up concrete walls and are joined by a special bolting arrangement using high strength bolts, nuts, and washers, including crushable spacers or washers. The reinforcing chord bars which run the width of the concrete wall are lap-spliced to the chord bar dowels of the connectors. The lap-splices developed the full strength of the reinforcing bars cast into the prefabricated walls.

The connector is comprised of two or more chord bars securely welded to face plates brought into adjacent relationship when the prefabricated tilt-up walls are assembled. The face plate of each connector are provided with three or more oversized holes for receiving bolts to connect adjacent tilt-up walls. These holes are oversized to compensate for slight misalignment between adjacent erected wall panels. The chord bars, or dowels, are inserted in holes in the face plate intermediate the bolt holes and plug welded securely to the face plate. This welding can be performed in the shop to produce a more reliable weld than that of field-weld methods. Even if standard grade reinforcing bars are used for the dowels, shop fabrication techniques provides the quality control necessary for producing a good weld. Preferably, if mass production is resorted to for producing the connectors, they would use weldable grade steel dowels to reduce costs by eliminating preheating and cooling steps and at the same time produce a more reliable, quality weld. Preferably the bolts for the connectors are high strength steel and their arrangement in the connection subjects them to direct tension stresses.

A unique feature of the invention is the use of crushable washers with each bolt. The crushable spacer can be made of any suitable crushable material, such as felt, or be configured to deflect like that of Bellville spring washers. A compression of the crushable spacer of $\frac{1}{8}$ inch per 20 foot width of concrete panel should be adequate. In assembling the connection, the nut when placed on the bolt is only finger tightened and should not crush the spacer during installation.

Assembly of the chord bar connectors to join adjacent prefabricated walls allows movement of the panels as they decrease in size from concrete drying shrinkage or temperature decrease. The movement is accommodated by crushing of the spacer. Although the prefabricated panels are free to move by small amounts during seismic events when the building becomes loaded, the crushable spacers will bottom out and the bolts will pick up the tension loads.

During lateral loading one wall of a building will be placed in tension, while the opposite wall is in compression. Transfer of compressive forces across adjacent connectors is provided for by shimming between face plates of adjacent connectors. The shims loosely fill the gap between the adjacent face plates with a small portion of the gap remaining unfilled. This small gap permits free movement of the panels during expansion of the concrete from temperature increase.

A conventional procedure, after adjacent chord bar connectors are joined, is to fill the recesses with dry packed concrete. An air gap between the bolt heads and the dry packed concrete for the bolted connection is provided so that the bolt heads can move during expansion of the panel. This air gap is created by placing plastic cups over bolt heads, or by using a crushable material, such as Styrofoam or felt around the bolt heads. Alternately, the air gap could be provided at the nutend of the bolts.

Two types of movement occur when panels are effected by temperature and moisture changes in the concrete. One type of movement is axial expansion or contraction of the walls; the other type is warping or curling action from differential temperature or moisture conditions across the thickness of the panel. The bolted connectors of the present invention do not restrain either the axial or curling movements of the wall. This freedom of movement is in dramatic contrast to the field-welded connectors which restrain both types of movement. The development of cracks will be significantly fewer in walls of tilt-up buildings having the bolted chord bar connectors if the invention is used rather than field-welded connections.

An additional advantage of the bolted connectors is safety during construction if an Earthquake should occur. When adjacent prefabricated wall panels are erected it is possible to immediately install bolts through the face plates of the bolted connectors. This provides a partially constructed building with an effective chord bar system, that will prevent the walls from collapsing during seismic activity. With the present field-welded construction the usual procedure is to wait a period of time (days) before welding the connection to allow for drying shrinkage before the walls are restrained from movement. During this period the walls are braced and the roof can be constructed. If seismic activity should occur at this time without an effective chord bar connection system in place, there can be the danger of the walls and roof collapsing.

Another significant advantage is the time saving in construction schedules. Once prefabricated tilt-up panels are erected and the chord bar connectors joined installation of the roof can begin. Conventionally, roof installation does not start until the chord bars are field-welded, which process can require from one to two weeks depending upon the size of the building. With the bolted chord bar connector system of the present invention, roof construction can begin immediately after bolting is completed. This can result in a savings of one to two weeks which is significant as total construction schedules are usually no longer than six months.

The above and other features of this invention will be fully understood from the following detailed description and the accompanying drawings, in which:

DETAILED DESCRIPTION OF THE INVENTION PER EMBODIMENT

Figure 1:
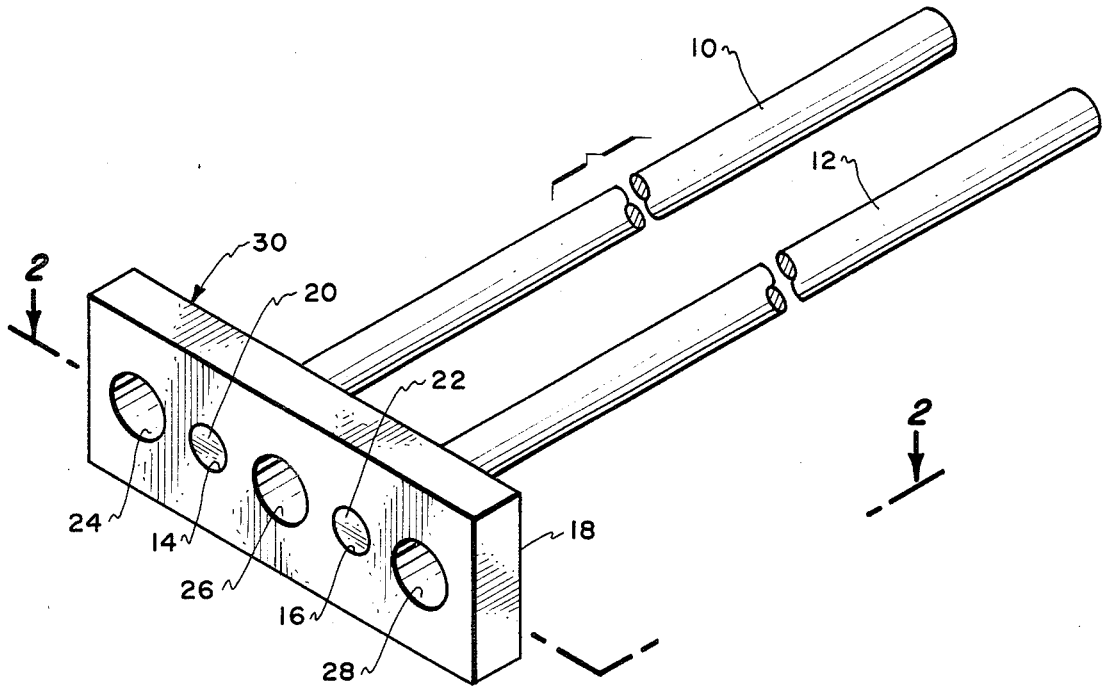
FIG. 1 is a perspective view of a chord bar connector constructed according to the invention.
Figure 2:
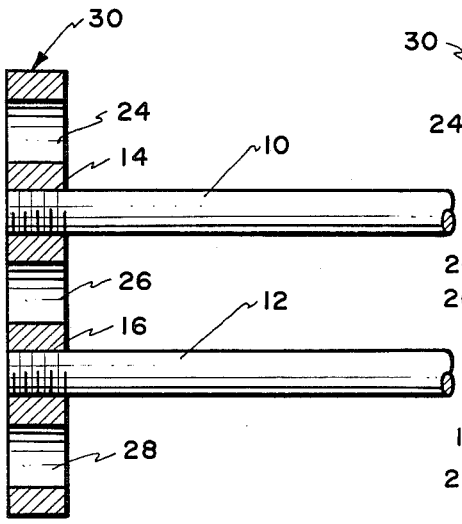
FIG. 2 is a sectional view taken at 2—2 of FIG. 1.

A chord bar connector reinforcing system for incorporation into prefabricated tilt-up concrete wall panels is illustrated generally in FIGS. 1 and 2. Connector 30 has chord bars 10 and 12 inserted in apertures 14 and 16 in face plate 18 and plug welded as shown at 20 and 22 of FIG. 2. An advantage of this construction illustrated is that the dowels formed by chord bars 10 and 12 can be shop-welded producing a more reliable weld than field-welded systems. The reinforcing bars 10 and 12 can be standard grade steel because shop fabrication can provide the necessary controls for quality welding. Further, chord bar connector 30 can be mass produced if desired using weldable grade steel for chord bars 10 and 12, because costs would be reduced from the elimination of preheating and cooling steps, and, at the same time, improve reliability and the quality of welds. Face plates 18 are provided with oversized bolt holes 24 and 26 and 28 to compensate for any misalignment during the erection and installation of adjacent prefabricated wall panels.

Figure 3:
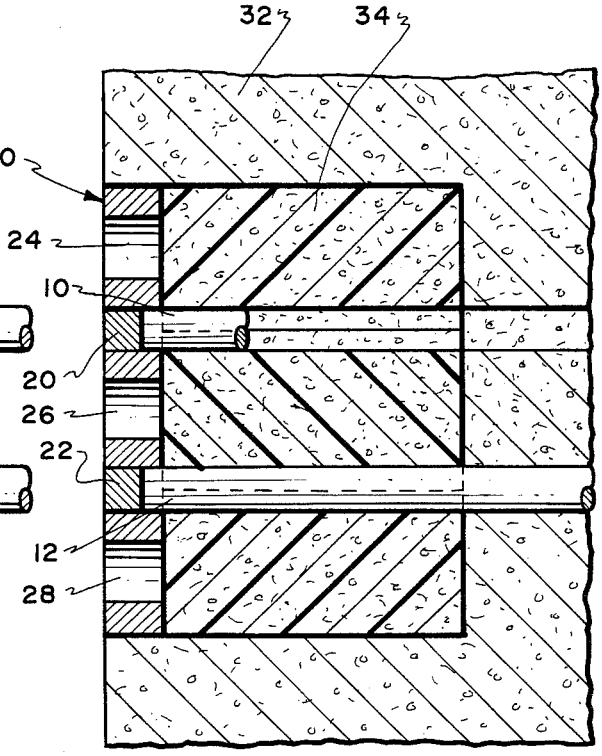
FIG. 3 is an enlarged partial section of a prefabricated tilt-up wall with the chord bar connector of the invention installed.
Figure 4:
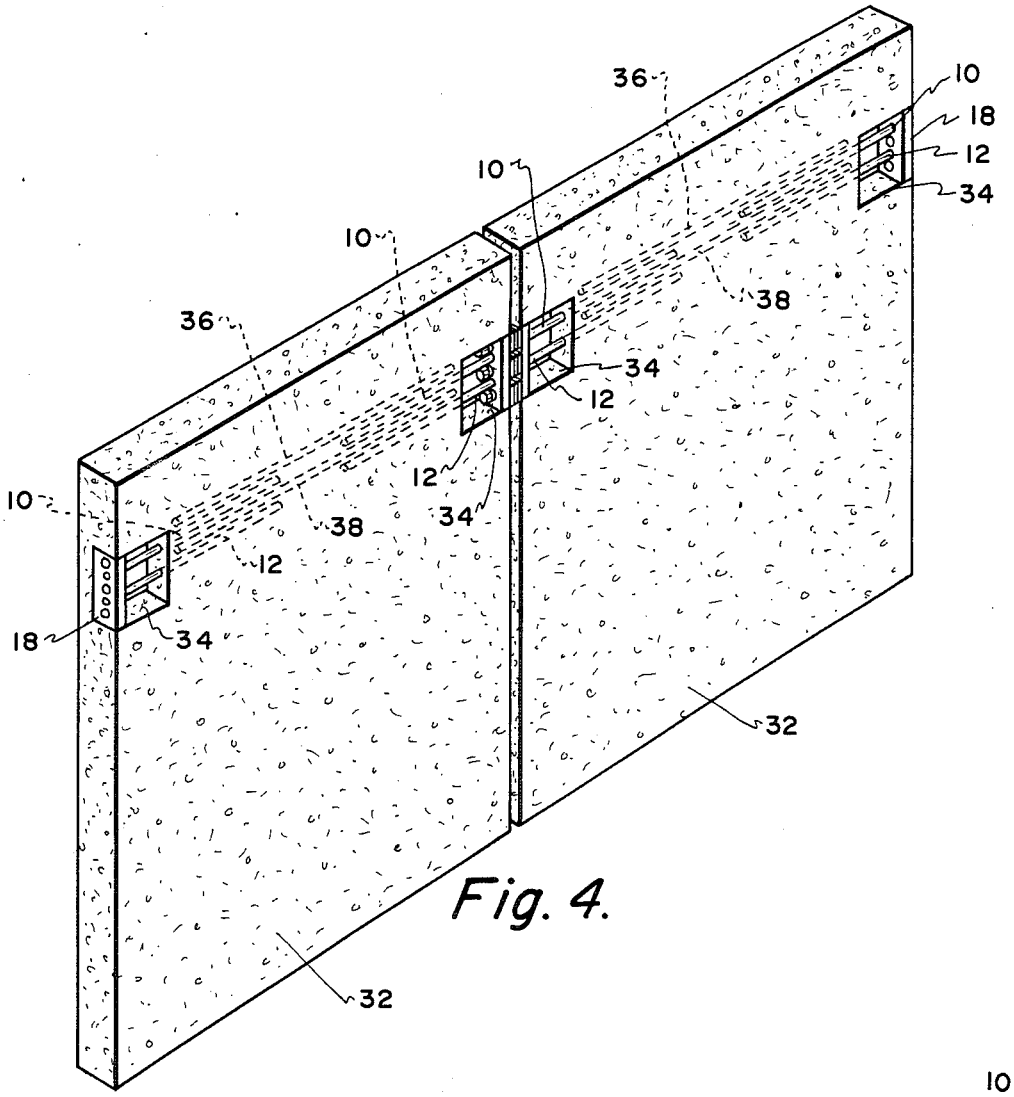
FIG. 4 illustrates the joining of adjacent prefabricated walls with the chord her connector of the invention.

The installation of the chord bar connectors in prefabricated tilt-up wall panels 32 is illustrated in FIG. 3 and FIG. 4. Assembled chord bar connector 30 is laid in a form (not shown) for creating concrete wall panel 32. A notch or pocket 34 is formed by removable inserts 34 which may be of any suitable material, such as a Styrofoam. Chord bars 10 and 12 are lap-spliced to reinforcing chord bars which run the width of the prefabricated wall panel 32 as shown in FIG. 4. After the concrete sets up, prefabricated wall panels 32 are ready for installation.

Figure 5:
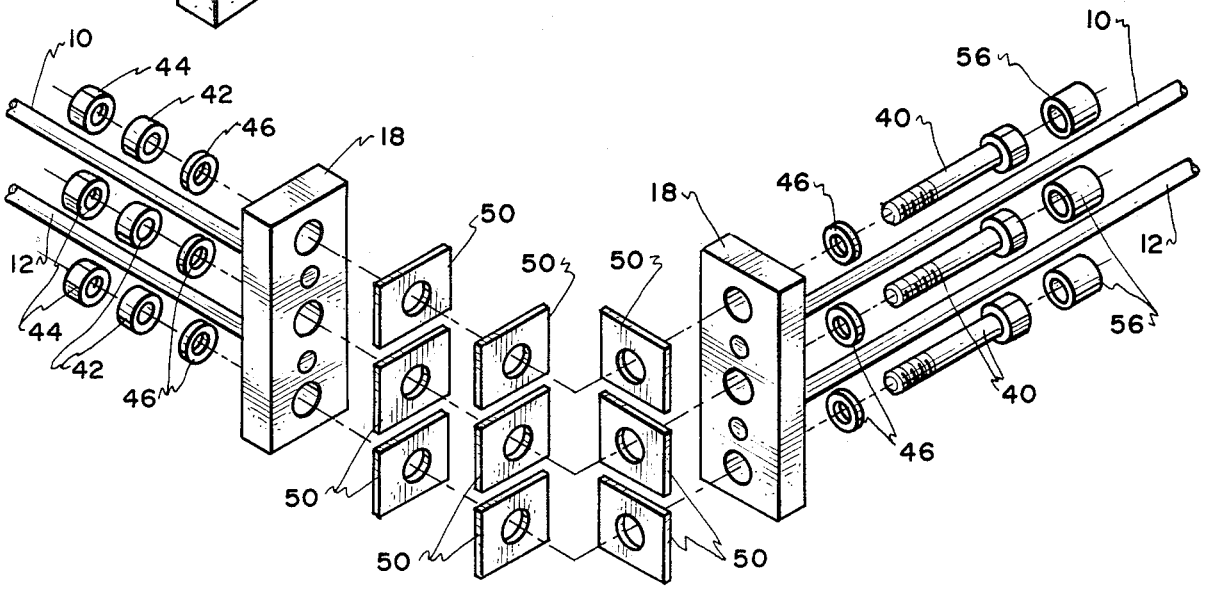
FIG. 5 is an exploded view illustrating the bolting of adjacent face plates of the chord bar connector.

Prefabricated wall panels 32 are tilted-up into position and adjacent chord bar connectors 30 joined by a typical bolt assembly as illustrated in FIG. 5. High tensile strength bolts 40 are passed through holes 24, 26 and 28 in respective face plates 18 and secured with nuts 44. Crushable spacers or washers 42 are located at either face plate 18. Nuts 44 are only finger tightened on bolts 40 so that crushable washers 42 are not compressed. Wall panel movement from drying shrinkage of the concrete or temperature decrease will compress the crushable washers 42.

The chord bar connector reinforcing system incorporated in tilt-up concrete wall panels is shown installed in FIG. 4. Tilt-up concrete wall panels 32 have overlapping reinforcing chord bars 36 and 38 which are lap-spliced to the dowels, or chord bars, of the connector units. Lap-splices developed the full strength of the reinforcing bars in tension.

The joining of two adjacent chord bar connectors 30 is illustrated in FIG. 5. Each chord bar connector 30 is comprised face plate 18 and chord bar dowels 10 and 12. A typical bolt assembly of bolts 40, crushable spacers or washers 42, nuts 44, and washers 46, is illustrated. In the embodiment shown the chord bar connector has chord bar dowels 10, 12 and face plates 18 for receiving three bolts. Optional chord bar constructions can have one dowel and two bolts, three dowels and four bolts, two dowels and one bolt, or three dowels and two bolts, where the number of dowels matches the number of required chord bars. Shims 50 loosely packed in the gap space between adjacent face plates 18 permitting additional free movement of the panels.

Figure 6:
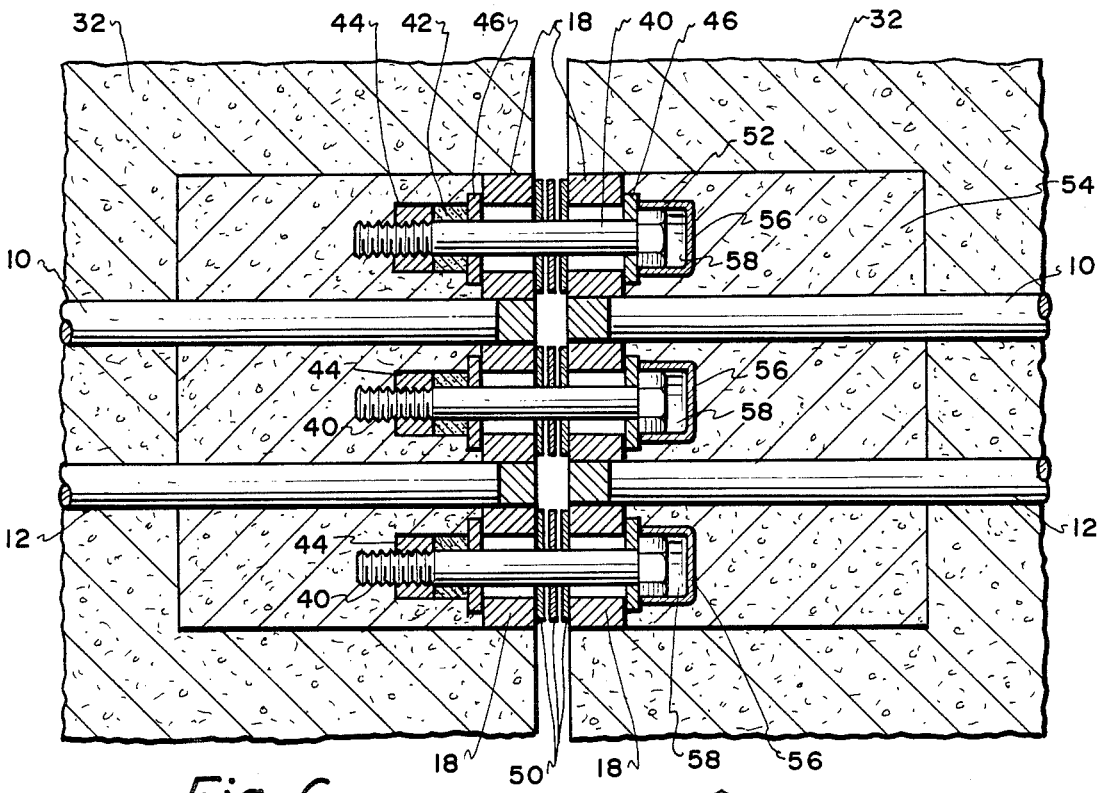
FIG. 6 is a partial sectional view of adjacent prefabricated tilt-up walls joined by the chord bar connector system of the invention.

A cross sectional view of the assemble bolted adjacent chord bar connector is illustrated in FIG. 6. Bolts 40 are preferably high strength steel with steel washers 46 provided to cover oversized holes 24, 26 and 28. Crushable spacers or washers 42 can be provided either under the nut 44 or under the bolt head 52. Nuts 44 are installed only finger tight on bolts 40.

Notches or pockets 34 in opposite edges of concrete panels 32 are filled with dry pack concrete 54 after installation of plastic cups 56 around bolt heads 52 to provide an air gap 58 between the bolt head and concrete 54.

Adjacent panels may be secured at corners by having face plates 18 mounted at approximately forty five degree angles to the dowels so that the corners when brought together will bring the face plates into substantially mating relationship for joining with bolts as described previously. As an alternative the corners can be joined by adding an additional steel angle abutting each face plate secured by bolts. These methods are well within the skill of those knowledgeable in this art.

Figure 7A:
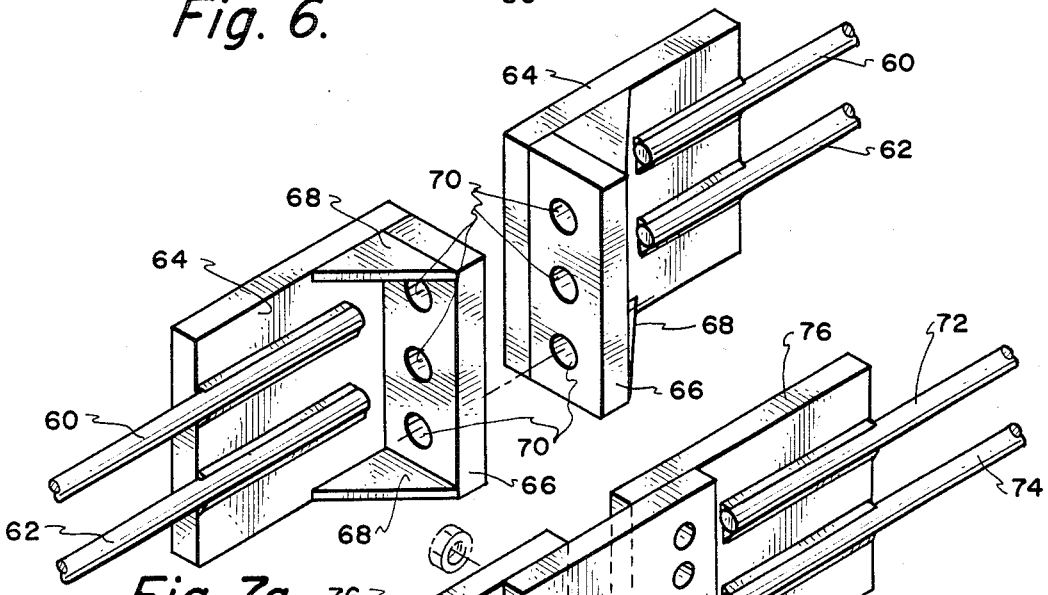
FIG. 7*a* is a view of an alternate construction for the chord bar connector according to the invention.
Figure 7B:
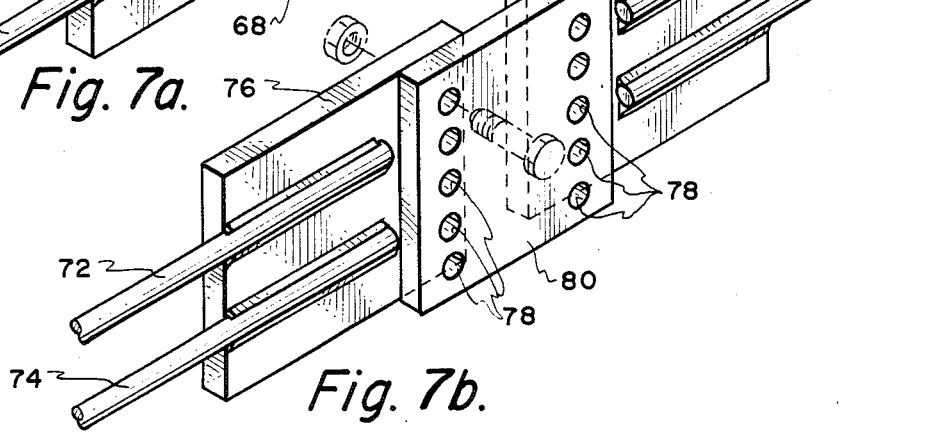
FIG. 7*b* is a view of another alternate construction for the chord bar connector according to the invention.

Alternative but less preferred chord bar connector designs are shown in FIG. 7*a* and FIG. 7*b*. In the embodiment of 7*a* a two chord bar connector is shown having chord bar dowels 60, and 62 welded to parallel plate 64. Face plates 66 are securely fillet welded to plates 64 and reinforced with welded plates 68 at the top and bottom. In the embodiment shown three bolt holes 70 for each face plate 66 are shown, although there could be more or less depending upon design requirements.

In the embodiment of FIG. 7*b* chord bar dowels 72 and 74 are fillet welded to parallel plates 76. As before the assembled chord bar connectors are embedded in the prefabricated concrete wall with the ends of plates 76 exposed. Each welded plate 76 will have several bolt holes 78 for joining adjacent ends. An overlapping plate 80 will then be bolted to the adjacent ends of chord bar plates 76. Holes 78 will, again, be oversized or even be in the form of slots to allow some lateral movement of adjacent walls.

Other possible alternatives are the welding of face plates 18 to very long dowels so that the chord bar dowels can be lap-spliced to the dowels of the connector at the other end on the prefabricated panel. Alternately the chord bar dowels can extend the full width of the panel with face plates at each end flush with the wall panel end surfaces to eliminate lap-splices. A disadvantage of the latter is that no length adjustment would be permitted.

A still further alternative is that dry-pack concrete 54 need not be used to fill recesses or pockets 34 after assembling of bolts is complete. Instead, the recess can be covered with a metal plate that is hung from a bolt stud-welded to the top-most part of one of face plates 18. In the latter case caps 56 over bolt heads 52 will not be needed. Chord bar dowels 10 and 12 may also be joined to face plates 18 by threading or fillet welding if desired.

This invention is not to be limited by the embodiment shown in the drawings and described in the description which is given by way of example and not of limitation, but only in accordance with the scope of the appended claims.

What is claimed is:

1. In a prefabricated tilt-up wall construction having chord bar connectors for joining adjacent walls, the improvement comprising:

flat rectangular steel face plate means, said face plate having at least four apertures; at least two of said apertures being substantially oversized bolt holes;

at least two elongate straight chord bars positioned perpendicular to said flat rectangular in two of said apertures, said at least two elongate chord bars being securely attached to said flat rectangular face plate;

said at least two elongate chord bars having a length selected to overlap with and be lap-spliced to reinforcing bars spanning substantially the entire width of said prefabricated concrete wall when said flat rectangular face plate is precast in said prefabricated concrete walls;

said elongate straight chord bar means with said face plate means being cast into prefabricated concrete wall panels with said face plate means flush with opposite end surfaces of said wall panel;

bolt means for bolting adjacent prefabricated concrete wall panels together by joining adjacent face plate means;

said bolt means including crushable washer means on said bolt shank between a nut threaded on said bolt shank and said bolt head for compensating for expansion and contraction of adjacent prefabricated wall panels when said adjacent panels are bolted together;

whereby prefabricated concrete wall panels may be safely and quickly erected and joined.

2. The tilt-up wall construction chord bar connector system according to claim 1 in which said plurality of elongate straight chord bars comprise at least two elongate straight chord bar means; and three alternating bolt holes on either side of said at least two elongate straight chord bar means.

3. The tilt-up wall construction chord bar connector system according to claim 1 in which said at least two elongate chord bars are plug welded to said flat rectangular face plate.

4. The tilt-up wall construction chord bar connector system according to claim 1 in which said at least two elongate chord bars are threaded into said apertures in said flat rectangular face plate.

* * * * *